US005275133A

United States Patent [19]

Sasaki et al.

[11] Patent Number: 5,275,133

[45] Date of Patent: Jan. 4, 1994

[54] APPARATUS FOR COOLING INTERNAL COMBUSTION ENGINE HAVING A SUPERCHARGER

[75] Inventors: Toshio Sasaki, c/o Kabushiki Kaisha Komatsu Seisakusho Oyama Works, 400 Yokokura-Shinden, Oyama-shi, Tochigi-ken 323; Yasukuni Kawashima, Oyama, both of Japan

[73] Assignee: Toshio Sasaki, Japan

[21] Appl. No.: 469,474

[22] PCT Filed: Jul. 24, 1989

[86] PCT No.: PCT/JP89/00737

§ 371 Date: May 29, 1990

§ 102(e) Date: May 29, 1990

[87] PCT Pub. No.: WO90/01621

PCT Pub. Date: Feb. 22, 1990

[30] Foreign Application Priority Data

Aug. 3, 1988 [JP] Japan ..... 63-102440[U]

[51] Int. Cl.[5] ..... F01P 1/06

[52] U.S. Cl. ..... 123/41.31; 123/41.54; 60/605.3

[58] Field of Search ..... 123/41.31, 41.54; 60/605.3

[56] References Cited

U.S. PATENT DOCUMENTS

| | | | |
|---|---|---|---|
| 3,726,262 | 4/1973 | Moon | 123/41.54 |
| 4,107,927 | 8/1978 | Gordon, Jr. et al. | 60/605.3 |
| 4,231,424 | 11/1980 | Moranne | 123/41.54 |

FOREIGN PATENT DOCUMENTS

| | | |
|---|---|---|
| 53-99436 | 8/1978 | Japan . |
| 60-116034 | 8/1985 | Japan . |
| 60-147720 | 10/1985 | Japan . |

*Primary Examiner*—Noah P. Kamen
*Attorney, Agent, or Firm*—Welsh & Katz, Ltd.

[57] ABSTRACT

The present invention provides an apparatus for cooling an internal combustion engine having a supercharger attached thereto, wherein the apparatus includes communication passages and by way of which the upper end of a coolant flow passage for circulating coolant through the internal combustion engine and a coolant flow passage for circulating coolant through the supercharger communicates with an upper tank installed on a radiator so that cooling of the supercharge and separating of air from coolant can simultaneously be accomplished by arranged of the communication passages.

2 Claims, 3 Drawing Sheets

APPARATUS FOR COOLING INTERNAL COMBUSTION ENGINE HAVING A SUPERCHARGER

TECHNICAL FIELD

The present invention relates generally to an apparatus for cooling an internal combustion engine having a supercharger attached thereto. More particularly, the present invention relates to piping structure for a coolant circulating passage for allowing coolant to circulate through the supercharger to cool the latter.

BACKGROUND ART

A variety of endeavors have been heretofore made for an internal combustion engine having a supercharger attached thereto for the purpose of preventing the temperature of a bearing portion for the supercharger from being elevated as a rotational shaft of the engine is rotated at a high speed and moreover improving the performance of the lubricant for cooling the bearing portion by bringing coolant into the bearing portion to cool it after the coolant flows through a housing of the engine to cool it.

FIG. 3 is an explanatory view which schematically illustrates the structure of a conventional apparatus for cooling an internal combustion engine having a water-cooled supercharger of the aforementioned type attached thereto.

With the conventional apparatus shown in FIG. 3, a housing of the engine is cooled in such a manner as described hereinafter.

In detail, coolant is cooled by radiating heat via a radiator b and the cooled coolant is then introduced into a coolant pump f via a lower tank of the radiator b, an outlet pipe d and a coolant inlet pipe e. The coolant pump f is driven by the engine so as to pump coolant through a coolant circulating passage g in the engine a to cool a cylinder block h, a cylinder head i and other components. It should be noted that FIG. 3 shows only a part of the coolant circulating passage g corresponding to the cylinder head i.

After coolant cools the interior of the engine a, it is finally brought into a thermostat housing j. The thermostat housing j includes a thermostat k for the purpose of regulating the flow rate of coolant adapted to flow through the radiator b by opening or closing a valve in the thermostat k depending on the coolant temperature.

Now, it is assumed that the temperature of coolant in the engine a is maintained at a level higher than an adequate temperature acceptable for operation of the engine a. In this case, the thermostat k is brought in an opened state so that coolant is delivered to an upper tank p on the radiator b via the thermostat k, a coolant outlet pipe l, a pipe m and an inlet pipe n.

Then, coolant is cooled down to an adequate temperature in the radiator b, and the thus cooled coolant is delivered to the engine a to cool it by circulating therethrough.

On the other hand, in a case where the temperature of coolant in the engine a is maintained at a level lower than the aforementioned adequate temperature, the thermostat k is closed so that coolant is delivered directly to the coolant inlet pipe e via a bypass pipe g without flowing through the radiator b to cool the coolant. In such manner, the temperature of coolant in the engine a is maintained at an adequate level.

The manner of cooling the housing of the engine a is as described above. Next, description will be made below as to cooling of the supercharger r.

Specifically, to cool the supercharger r the apparatus includes a coolant feed pipe t by way of which a part of the coolant circulating passage g corresponding to the cylinder block h communicates with a bearing portion s for the supercharger r as well as a return pipe u by way of which the bearing portion s communicates with the outlet pipe With this construction, coolant in the coolant circulating passage g is delivered to a coolant flow passage in a center housing of the supercharger r via the coolant feed pipe t. As coolant flows through the coolant flow passage, heat exchange is accomplished between the coolant and the bearing portion s.

After completion of the cooling operation for the supercharger r, coolant flows through the return pipe u so that the flow of coolant is united with the flow of coolant which has cooled the interior of the engine a, in the outlet pipe l. Then, the flow of the combined coolant is delivered to the upper tank p. Thereafter, coolant is cooled in the radiator b by radiating heat therefrom.

As is well known, the bearing portion s of the supercharger r is heated up to an elevated temperature as a rotational shaft of the supercharger r is rotated at a high speed. Thus, coolant tends to be vaporized in the supercharger.

Further, as the coolant pump f is driven at a high coolant temperature, the negative pressure appearing at the suction portion of the coolant pump f comes near to a specific saturated steam pressure, whereby steam tends to be generated. Additionally, air and vapor tends to be involved entrained in coolant for the reasons as described above. Moreover, air in the outside environment may be introduced into the coolant circulating passage g via gaskets for the coolant circulating passage g.

Once air and vapor are entrained in the coolant, it may lead to malfunctions such as accelerated generation of cavitation, reduction of cooling efficiency, irregular local cooling due to the residual air or the like malfunction.

For the reason, there arises the necessity to effectively separate air and vapor from coolant.

To meet the necessity, arrangement is made such that an air vent pipe v extends between the upper end of the coolant circulating passage and the upper tank p and a coolant feed pipe w extends between the upper tank p and the coolant inlet pipe e.

With this arrangement, air in the coolant circulating passage g is delivered to the upper tank p together with a small quantity of coolant via the air vent pipe v. Air is separated from coolant in the upper tank p so that coolant with no entrained air is delivered to the coolant inlet pipe e via the coolant feed pipe so as to allow coolant to circulate through the interior of the engine a.

However, it has been found that the conventional apparatus as constructed in the above-described manner has the following problems.

In detail, on completion of a cooling operation for the supercharger r, coolant is delivered directly to the outlet pipe l without flowing into the thermostat housing j and then it is cooled in the radiator b by radiating heat therefrom. In other words, coolant which has cooled the supercharger r is cooled by radiating heat from the radiator b, even when the coolant has a temperature lower than the adequate temperature.

Thus, particularly in the winter season, coolant is brought in a so-called overcooled state having a temperature much lower than the adequate temperature. This leads to a result that the engine a can not be operated properly.

As is apparent from the drawing, the position where the outlet pipe l extends is set lower than the position assumed by the supercharger r. With this arrangement, air tends to return to the supercharger r side. Additionally, steam generated at the bearing portion s and other components remains, the joint portion between the return pipe u and the outlet pipe l. As a result, separation of air from coolant can not be accomplished completely.

The aforementioned type of apparatus should be constructed and fabricated with a reduced number of components and manhours at an inexpensive cost on a mass-production line.

The present invention has been made with the foregoing background in mind and its object resides in providing an apparatus for cooling an internal combustion engine having a supercharger attached thereto, wherein an occurrence of overcooling can reliably be prevented, air can completely be separated from coolant and the apparatus can advantageously be fabricated at an inexpensive cost on a mass-production line.

DISCLOSURE OF THE INVENTION

To accomplish the above object, the present invention provides an apparatus for cooling an internal combustion engine having a supercharger attached thereto, the apparatus including an upper tank into which coolant for cooling the supercharger and the internal combustion engine is introduced to separate air from the coolant, the upper tank being installed on a radiator, wherein the apparatus further includes passages by way of which the upper end of a coolant flow passage for circulating coolant through the internal combustion engine and a coolant flow passage for circulating coolant through the supercharger communicate with the upper tank.

Specifically, after completion of a cooling operation for the internal combustion engine, coolant is delivered to a coolant flow passage in the supercharger from the upper end of a coolant flow passage in the internal combustion engine to cool the supercharger. At the same time, air remaining at the upper end of the coolant flow passage in the internal combustion engine is delivered to the upper tank via the coolant flow passage in the supercharger. Air is separated from the air-containing coolant in the upper tank, whereby coolant with no air returns to the coolant flow passage in the internal combustion engine.

BEST MODE FOR CARRYING OUT THE INVENTION

Now, the present invention will be described in detail hereinafter with reference to the accompanying drawings which illustrate an apparatus for cooling an internal combustion engine having a supercharger attached thereto in accordance with an embodiment of the present invention.

Figure 1:
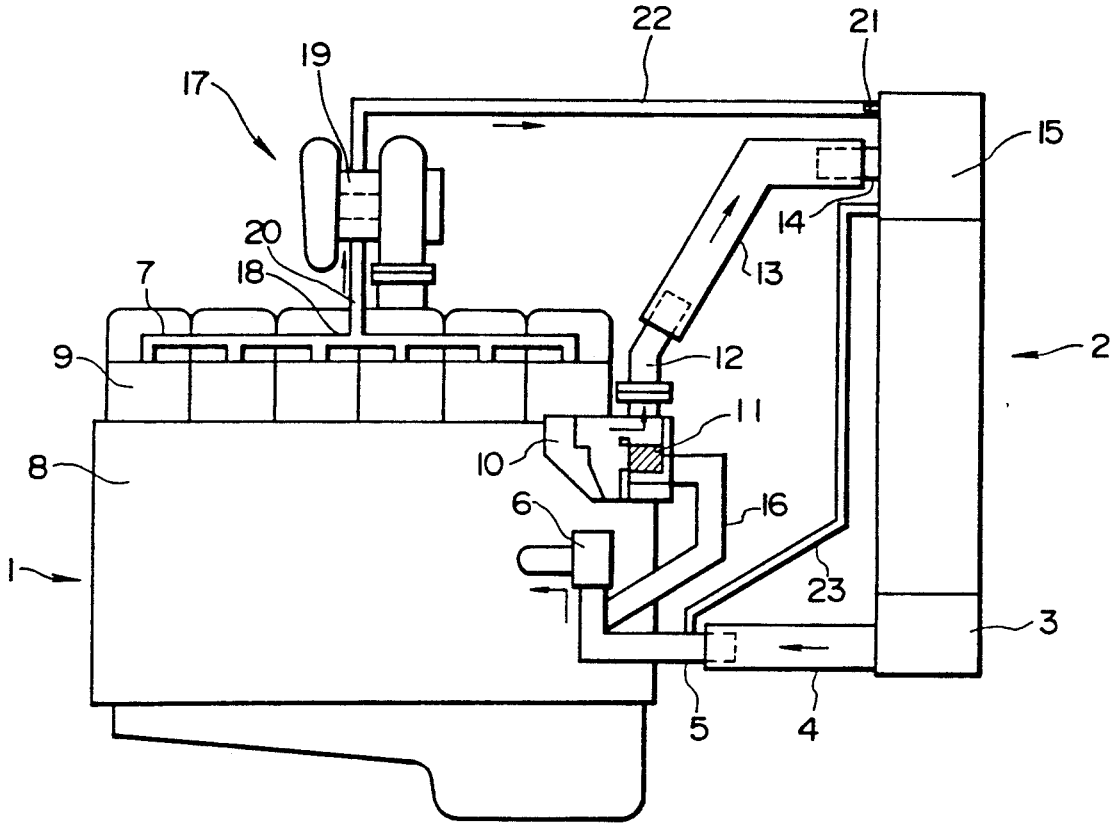
FIG. 1 is an explanatory view which schematically illustrates an apparatus for cooling an internal combustion engine having a supercharger attached thereto in accordance with an embodiment of the present invention.

Referring to FIG. 1, the engine 1 includes a housing which is cooled in the same manner as a conventional apparatus in the following.

Specifically, coolant is cooled by radiating heat from a radiator 2 and then the cooled coolant is introduced into a coolant pump 6 via a lower tank 3 of the radiator 2, an outlet pipe 4 and a coolant inlet pipe 5. The coolant pump 6 is driven by the engine 1 so as to allow coolant to flow through a coolant circulating passage 7 in the engine 1 to cool a cylinder block 8, a cylinder head 9 and other components. It should be noted that FIG. 1 shows merely a part of the coolant circulating passage 7 which corresponds to the cylinder head 9.

After coolant cools the interior of the engine 1, it is finally introduced into a housing 10 for a thermostat to be described later. The housing 10 includes a thermostat 11 for opening or closing its valve in response to variation of the temperature of coolant in the engine 1 to regulate a flow rate of coolant which is to flow through the radiator 2.

Now, it is assumed that the temperature of coolant in the engine 1 is held at a level higher than an adequate temperature preferably acceptable for operation of the engine 1. In this case, the thermostat valve 11 is opened, causing coolant to be introduced into an upper tank 15 of the radiator 2 via the thermostat valve 11, a coolant outlet pipe 12, a pipe 13 and an inlet pipe 14.

Subsequently coolant is cooled down to the aforementioned adequate temperature by the radiator 2, and thereafter it circulates through the engine 1.

On the other hand, in a case where the temperature of coolant in the engine 1 is held at a level lower than the adequate temperature, the thermostat valve 11 closed, whereby coolant is delivered directly to the coolant inlet pipe 5 via a bypass pipe 16 without flowing through the radiator 2 to cool it. In this manner, the temperature of coolant in the engine 1 is maintained at an adequate level.

The manner of cooling the housing of the engine 1 is as described above. Next, description will be made below as to cooling of a supercharger 17.

In detail, to cool the supercharger 17, the apparatus includes a coolant feed pipe 20 by way of which an upper end 18 of the coolant circulating passage 7 is communicated with a bearing portion 19 for the supercharger 17 as well as a return pipe 22 by way of which the bearing portion 19 communicates with a joint portion 21 for the upper tank 15. In addition, the apparatus includes a coolant feed pipe 23 which extends between the upper tank 15 and the coolant inlet pipe 5.

With such arrangement, the coolant feed pipe 20 and the return pipe 22 serve as a coolant flow passage for the supercharger 17 and at the same time they serve as an air vent pipe for separating air from coolant. It should of course be understood that arrangement is made for the upper tank 15 so as to allow the joint portion 21 to be located higher than the bearing portion 19.

Air in the coolant circulating passage 7 is brought up to the upper end 18 of the latter. Then, a small quantity of air-containing coolant is introduced into a coolant flow passage in the center housing of the supercharger 17 via the coolant feed pipe 20. As coolant flows through the coolant flow passage, heat exchange is carried out between the coolant and the bearing portion 19.

On completion of a cooling operation for the supercharger 17, coolant flows through the return pipe 22 to reach the joint portion 21. It should be added that steam generated in the bearing portion 19 and other components due to abrupt stoppage of the engine 1 or the like malfunction flows through the return pipe 22 to reach the joint portion 21.

Figure 2:
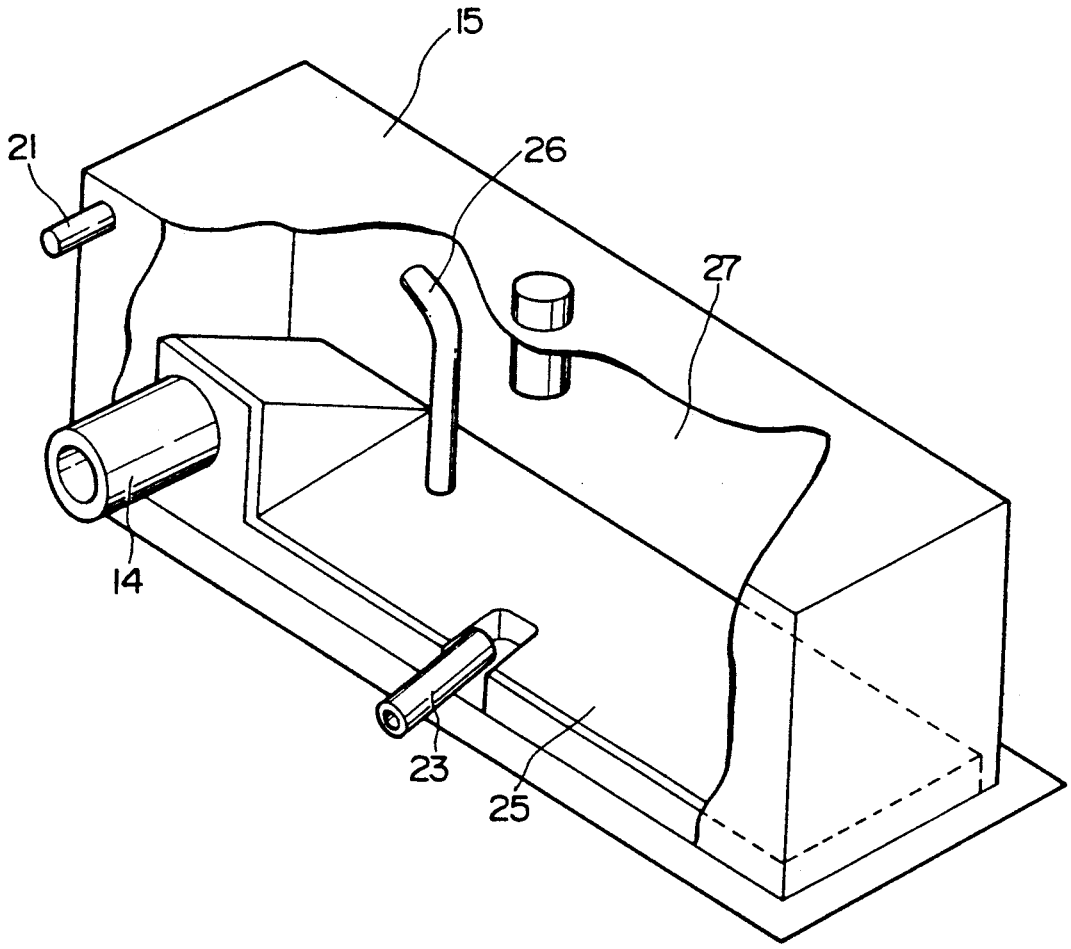
FIG. 2 is a perspective view which illustrates the inner structure of an upper tank for the apparatus shown in FIG. 1.
Figure 3:
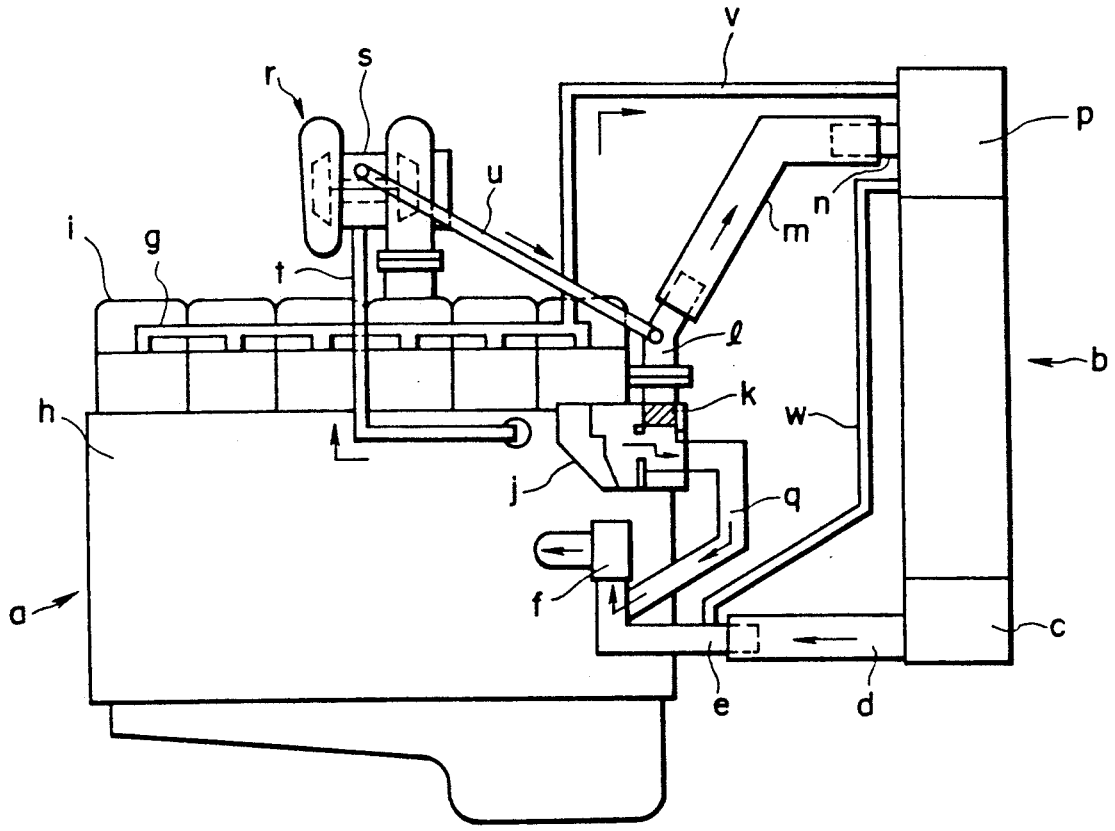
FIG. 3 is an explanatory view which schematically illustrates by way of example a conventional apparatus for cooling an internal combustion engine having a supercharger attached thereto.

FIG. 2 is a partially exploded perspective view which illustrates the inner structure of the upper tank 15.

Description will be made below as to the inner structure of the upper tank 15 with reference to FIG. 2. As air-containing coolant is introduced into the interior of an expansion chamber 24 via the joint portion 21, air is separated from the coolant in the expansion chamber 24. After completion of the separating operation, the coolant with no air is delivered to the coolant inlet pipe 5 via the coolant feed pipe 23 which opening is located slightly lower than a partition 25 so that it returns to the coolant circulating passage 7.

In FIG. 2, reference numeral 26 designates an air vent pipe. The air vent pipe 26 serves to separate air from the coolant in the interior of a radiator core below the upper tank 15.

As will be readily apparent from the above description, according to the above-described embodiment of the present invention, the coolant which has flowed through the supercharger 17 returns to the coolant circulating passage 7 via the upper tank 15 but not via the core portion of the radiator 2. In this connection, it should be noted that conventional apparatus is constructed such that the coolant which has flowed through the supercharger 17 returns to the coolant circulating passage 7 of the engine 1 via the core portion of the radiator 2, resulting in a danger that the coolant is overcooled.

Additionally, according to the embodiment of the present invention, the pipe, by way of which the bearing portion 19 of the supercharger 17 is communicated with the joint portion 21 of the upper tank 15, is slantwise upwardly arranged toward the joint portion 21. In this regard, since the conventional apparatus includes the same pipe as the aforementioned one so as to allow the bearing portion 19 of the supercharger 17 to communicate with the coolant outlet port 12 which is located lower than the bearing portion 19, steam may remain midway of the pipe and thereby complete separation can not be accomplished to separate air from coolant. In contrast with the conventional apparatus, the present invention assures that the aforementioned separation can be accomplished without fail.

Further, according to the embodiment of the present invention, the coolant feed pipe 20 and the return pipe 22 serve as a coolant flow passage for the supercharger and at the same time they serve as an air vent pipe for the purpose of separating air from coolant. In this regard, the conventional apparatus is constructed such that an air vent pipe for separating air from coolant is arranged separately from the coolant flow passage for the supercharger. As is apparent from a comparison between the apparatus of the present invention and the conventional apparatus, the present invention assures that the apparatus can be fabricated at a reduced cost by virtue of common arrangement of the coolant feed passage and the air vent pipe.

What is claimed is:

1. An apparatus for cooling internal combustion engine having a supercharger, said apparatus including a first coolant flow passage disposed in said internal combustion engine and a second coolant flow passage disposed in said supercharger, said apparatus delivering coolant within said first and second coolant flow passages to a core of a radiator to lower the temperature of the coolant; said apparatus delivering coolant within said first and second coolant flow passages to an upper tank provided at an upper portion of said core to separate air from the coolant in said upper tank, wherein an outlet of said core and an inlet of said first coolant flow passage communicate by means of a first pipe and, an outlet of said first coolant flow passage and an inlet of said core communicate by means of a second pipe thereby circulating the coolant in a circulation path formed by said core to said first pipe to said first coolant flow passage to said second pipe;

said second coolant flow passage being positioned higher than an upper end of said first coolant flow passage and said upper tank is positioned higher than an upper end of said second coolant flow passage;

said upper end of said first coolant flow passage and said second coolant flow passage communicate by means of a third pipe and, said upper end of said second coolant flow passage and said upper tank communicate by means of a fourth pipe, said third pipe and said fourth pipe are so arranged that the coolant level gradually becomes higher as the coolant passes from said upper end of said first coolant flow passage toward said upper tank through said third and fourth pipes.

2. An apparatus for cooling an internal combustion engine having a supercharger set forth in claim 1, wherein said upper tank and said core are separated by partition for preventing the coolant from flowing into said core, and said upper tank and the inlet of said fist coolant flow passage communicate from said fist pipe and through said first passage and through a fifth pipe.

* * * * *

UNITED STATES PATENT AND TRADEMARK OFFICE

CERTIFICATE OF CORRECTION

PATENT NO. : 5,275,133
DATED : January 4, 1994
INVENTOR(S) : Toshio Sasaki, et al It is certified that error appears in the above-identified patent and that said Letters Patent is hereby corrected as shown below:

Title page, item [73],
"Assignee: Toshio Sasaki, Japan" should be -- Assignee: Kabushiki Kaisha Komatsu Seisakusho --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*